US008443464B2

(12) United States Patent
Schumacher

(10) Patent No.: US 8,443,464 B2
(45) Date of Patent: May 21, 2013

(54) WADER RETENTION SYSTEM AND METHODOLOGY OF USE

(76) Inventor: Anthony Schumacher, Janesville, CA (US)

( * ) Notice: Subject to any disclaimer, the term of this patent is extended or adjusted under 35 U.S.C. 154(b) by 273 days.

(21) Appl. No.: 13/044,815

(22) Filed: Mar. 10, 2011

(65) Prior Publication Data

US 2012/0054938 A1 Mar. 8, 2012

Related U.S. Application Data

(60) Provisional application No. 61/312,778, filed on Mar. 11, 2010.

(51) Int. Cl.
*A41D 13/00* (2006.01)
*A41D 13/012* (2006.01)
*A41D 13/02* (2006.01)

(52) U.S. Cl.
USPC ..... 2/79; 2/82; 2/314; 36/7.1 R

(58) Field of Classification Search
USPC ..... 2/303, 314, 315, 316, 317, 318, 322, 2/335, 79, 82, 69, 22, 23, 24, 61, 62, 300, 2/312, 321, 46, 48, 51, 52, 231, 232, 233, 2/338, 240, 242, 311; 36/58.5, 7.1 R, 50.1, 36/4, 109, 7.3, 51, 56, 2 R
See application file for complete search history.

(56) References Cited

U.S. PATENT DOCUMENTS

| | | | | | |
|---|---|---|---|---|---|
| 876,091 | A | * | 1/1908 | Reed | 36/58.5 |
| 950,862 | A | * | 3/1910 | Nelson | 36/58.5 |
| 1,195,354 | A | * | 8/1916 | Guinzburg | 2/314 |
| 1,206,180 | A | * | 11/1916 | Ward | 36/58.5 |
| 1,302,677 | A | * | 5/1919 | Langhardt | 36/58.5 |
| 1,308,206 | A | * | 7/1919 | Tillson | 36/58.5 |
| 1,382,706 | A | * | 6/1921 | Wright | 2/315 |
| 1,542,331 | A | * | 6/1925 | Brockway | 36/58.5 |
| 1,842,996 | A | * | 1/1932 | Pelton | 2/315 |
| 1,845,527 | A | * | 2/1932 | Stevenson | 2/315 |
| 2,531,763 | A | * | 11/1950 | Andre | 36/117.8 |
| 2,596,112 | A | * | 5/1952 | Aines | 2/232 |
| 3,845,769 | A | | 11/1974 | Shaw | |
| 4,512,089 | A | | 4/1985 | Carrier | |
| 4,577,419 | A | | 3/1986 | Chassaing | |
| 4,599,811 | A | | 7/1986 | Rousseau | |
| 4,624,015 | A | | 11/1986 | Bottoms | |
| 4,689,902 | A | | 9/1987 | Lewis | |
| 4,856,207 | A | | 8/1989 | Datson | |
| 4,858,342 | A | * | 8/1989 | Nicholson et al. | 36/109 |
| 4,893,421 | A | | 1/1990 | Folks | |

(Continued)

*Primary Examiner* — Amy Vanatta
(74) *Attorney, Agent, or Firm* — John D. Long

(57) ABSTRACT

One possible embodiment of the invention could be a wader retention system comprising of a front leg securing portion and a back leg securing portion, the front leg securing portion attaches to an interior wall of a wader; the back leg securing portion comprises a belt, the belt having two ends, a first end permanently connects to the first leg securing portion while a second end adjustably and reversibly connects to the front leg securing portion to allow the two portions to form a leg channel through which at least a portion of an operator's leg and foot may be reversibly pass though when inserted into the wader; wherein the placement of the belt upon the front leg securing portion adjusts the circumference of the leg channel to allow the portions to reversibly and securely envelope a leg of an operator as located within the leg channel.

20 Claims, 5 Drawing Sheets

U.S. PATENT DOCUMENTS 5,022,096 A * 6/1991 Pacanowsky ..... 2/227
5,400,529 A 3/1995 Bell et al.
5,499,461 A 3/1996 Danezin et al.
5,590,481 A 1/1997 Vaccari
5,609,570 A 3/1997 Lamont
5,718,066 A 2/1998 Chemello et al.
5,832,632 A * 11/1998 Bergeron ..... 36/58.5
5,865,778 A 2/1999 Johnson
5,966,842 A 10/1999 Hart, Jr.
2001/0025383 A1 * 10/2001 Thompson ..... 2/69
2010/0306897 A1 * 12/2010 Wood et al. ..... 2/79
2011/0307993 A1 * 12/2011 McAfee ..... 2/82

* cited by examiner

WADER RETENTION SYSTEM AND METHODOLOGY OF USE

CROSS-REFERENCES TO RELATED APPLICATIONS

This application claims the benefit under 35 U.S.C. §119 (e) of U.S. Provisional Patent Application No. 61/312,778, filed on Mar. 11, 2010, the contents of which are relied upon and incorporated by reference.

STATEMENT REGARDING FEDERALLY SPONSORED RESEARCH OR DEVELOPMENT

Not Applicable

REFERENCE TO A "MICROFICHE APPENDIX"

Not Applicable.

FIELD OF THE INVENTION

The present invention generally relates to the waders. More particularly to those systems and methodologies for retaining waders upon the operator during the use of the waders.

BACKGROUND

Waders are substantially water-proof, boot ware that are traditionally used by sportsmen, such as water fowl hunters, fishermen, and others, for traversing wet areas. In some instances, the waders are boot/hip waders which could be seen as a pair of foot-leg coverings. Each individual foot-leg covering could have an individual a water proof leg covering section that are continuously connects to a water-proof boot covering section to generally encapsulate the operators' leg and foot (e.g., from foot to hip) to provide the covered area with protection from water incursion while leaving the upper portions of the operator's body (e.g., hip to head) exposed to such elements. Each boot/hip wader could have a leg aperture near its top (the aperture being continuously connected to the hollow interior of the wader) by which the operator inserts its leg and foot into the boot/hip wader.

In other instances, waders could be chest waders, which may be described as water-proof pants of unitary construction having water-proof sections generally encapsulating the body from mid/upper chest area down to and including the feet, substantially leaving upper chest, shoulders, arms and head unprotected from the aqueous elements. These waders also have a leg aperture near their top by which the operator may insert the lower portion of its body (legs and feet, and portions of the chest and back) into the chest wader.

One issue that repeatedly arises with the use of waders is that in the aqueous environments in which they are frequently used in, their operators often are stepping into thick concentrations of mud, muck, and the like, which show a great propensity to generate a very strong adhesive, sucking action against the boot or foot covering section of the wader that is placed within those concentrations This suction/adhesion force can be so great as to generally cause the operator to most unwantedly step out of his or her foot out of the boot or foot covering section of the wader while traversing such areas. This step-out action can occur with greater incidence when the operator's foot does not closely fit the boot covering section of the wader (e.g., the foot being significantly smaller in size relative to the wader's boot covering section.)

The step-out action may also have the undesired result in placing the leg aperture of the wader to coming closer to the surface of the water than the operator would normally desire. This result could further allow water to enter into the wader's normally dry interior through the aperture top of wader/covering. Although water in the wader interior could severely reduce the comfort of the operator, in some cases, water-filled waders could destabilizing the operator's balance to such a point that that the operator's ability to safely traverse such an aqueous environment is significantly impaired, placing the operator in a possible life-threatening situation.

Although such wader retention systems do exist, they could be seen as being generally cumbersome in use; substantially not easily adjusted to meet an individual operator's physical characteristics; and generally not easily to be applied to the person of the operator.

What is needed therefore is a system and methodology that is easily adjusted, easy-to-apply to the operator, and easy-to-retain the operator's foot within the boot covering section of the wader(s) when the wader(s) is used in an aqueous-type of environment.

SUMMARY OF ONE EMBODIMENT OF THE INVENTION

Advantages of One or More Embodiments of the Present Invention

The various embodiments of the present invention may, but do not necessarily, achieve one or more of the following advantages:

to provide a wader with a wader retention system at economic cost with little modification required of the wader;

the ability to allow the wader to quickly grasp and reversibly lock onto a portion of operator's leg;

to provide a wader retention system that easily adjusts for different sizes and shapes of the attachment area of the operator's leg;

the ability to easily modify the structure of a current wader to deploy an simpler and easier-to-use wader retention system;

the ability to attach a wader to an operator to resist the suction force of mud and alike in an aquatic environment to provide wader retention system that quickly, easily, and reversibly grasps a portion of the operator's leg to resist the pulling of the wader off of the operator's foot.

These and other advantages may be realized by reference to the remaining portions of the specification, claims, and abstract.

Brief Description of One Embodiment of the Present Invention

One possible embodiment of the invention could be a wader retention system comprising a front leg securing portion and a back leg securing portion, the front leg securing portion attaches to an interior wall of a wader, that interior wall further denotes a hollow interior into which a foot and leg of an operator can be inserted; the back leg securing portion comprises a belt, the belt having two ends, a first end permanently connected to the first leg securing portion while a second end adjustably and reversibly connects to the front leg securing portion to allow the two portions to form a leg channel through which at least a portion of an operator's leg and foot may be reversibly pass though; wherein the placement of the belt upon the front leg securing portion adjusts the circumference of the leg channel to allow the portions to reversibly and securely envelope the leg of an operator as placed within the leg channel to retain the wader upon the operator.

Another possible embodiment could be a methodology of retaining a leg within a wader comprising of the following steps, providing a wader having a wader retention system, the system comprising of a front leg securing portion and a back leg securing portion that together form a leg channel with an adjustable circumference, the front leg securing portion attaches to an interior wall of the wader, the back leg securing portion comprising of a belt with two ends, a first end that permanently attaches to the front leg portion and second end that reversibly and adjustably attaches on the front leg securing portion; inserting a foot and leg of an operator into the wader to pass through the leg channel; and positioning the second end relative to the front leg securing portion so that the system snugly contacts the leg to hold it within the wader.

Yet another embodiment of the invention could be a wader with a wader retention system comprising of a leg covering section in continuous communication with a boot covering section, the sections sharing a common interior wall denoting a hollow interior continuously connected with leg aperture for receiving at least a portion of an operator's leg and foot, wader retention system having a front leg securing portion and a back leg securing portion, the front leg securing section attaches to the interior wall, the front leg portion further at least partially encapsulates a portion of an operator's leg placed in the hollow interior; the back leg securing portion comprises a belt, the belt having two ends, a first end permanently connected to the first portion while a second end adjustably and reversibly connects to the front leg securing portion to allow the two portions to form a leg channel through which at least a portion of an operator's leg and foot may be reversibly pass though; wherein the placement of the belt upon the front leg securing portion adjusts the circumference of the leg channel to allow the portions to reversibly and securely envelope a portion of the leg of an operator placed in the leg channel so as to retain the wader upon the operator.

The above-description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
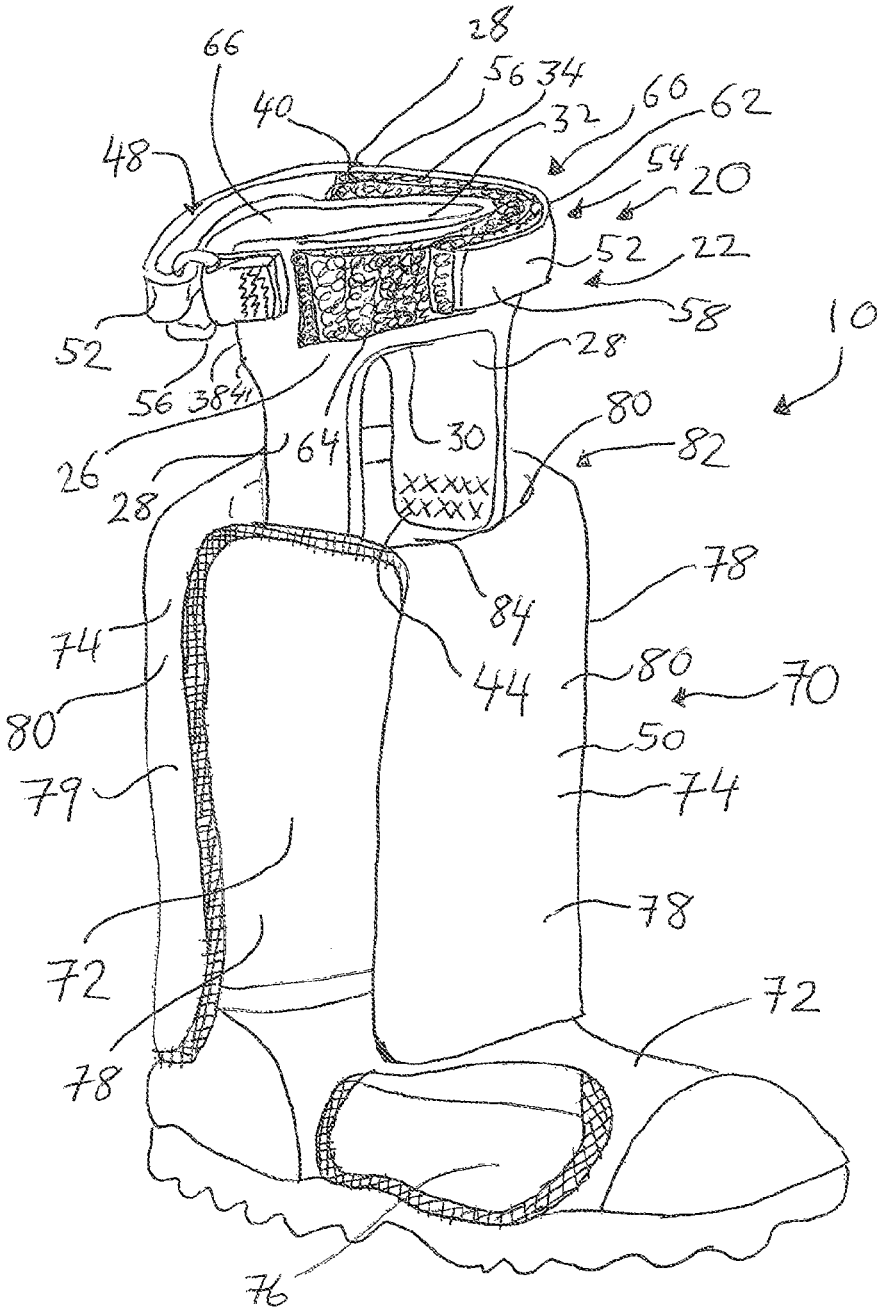
FIG. 1 is substantially a cutaway perspective view of one embodiment of present invention.
Figure 2:
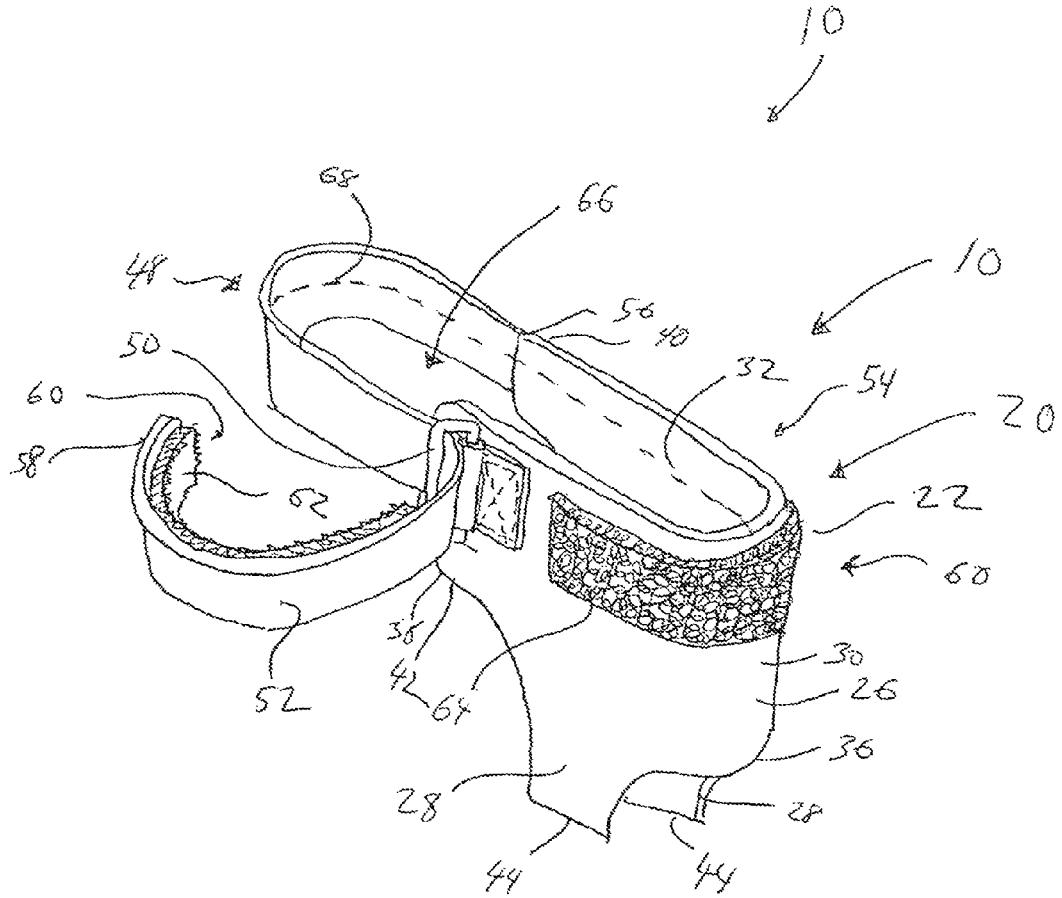
FIG. 2 is substantially a perspective view of one embodiment of wader retention system.
Figure 3:
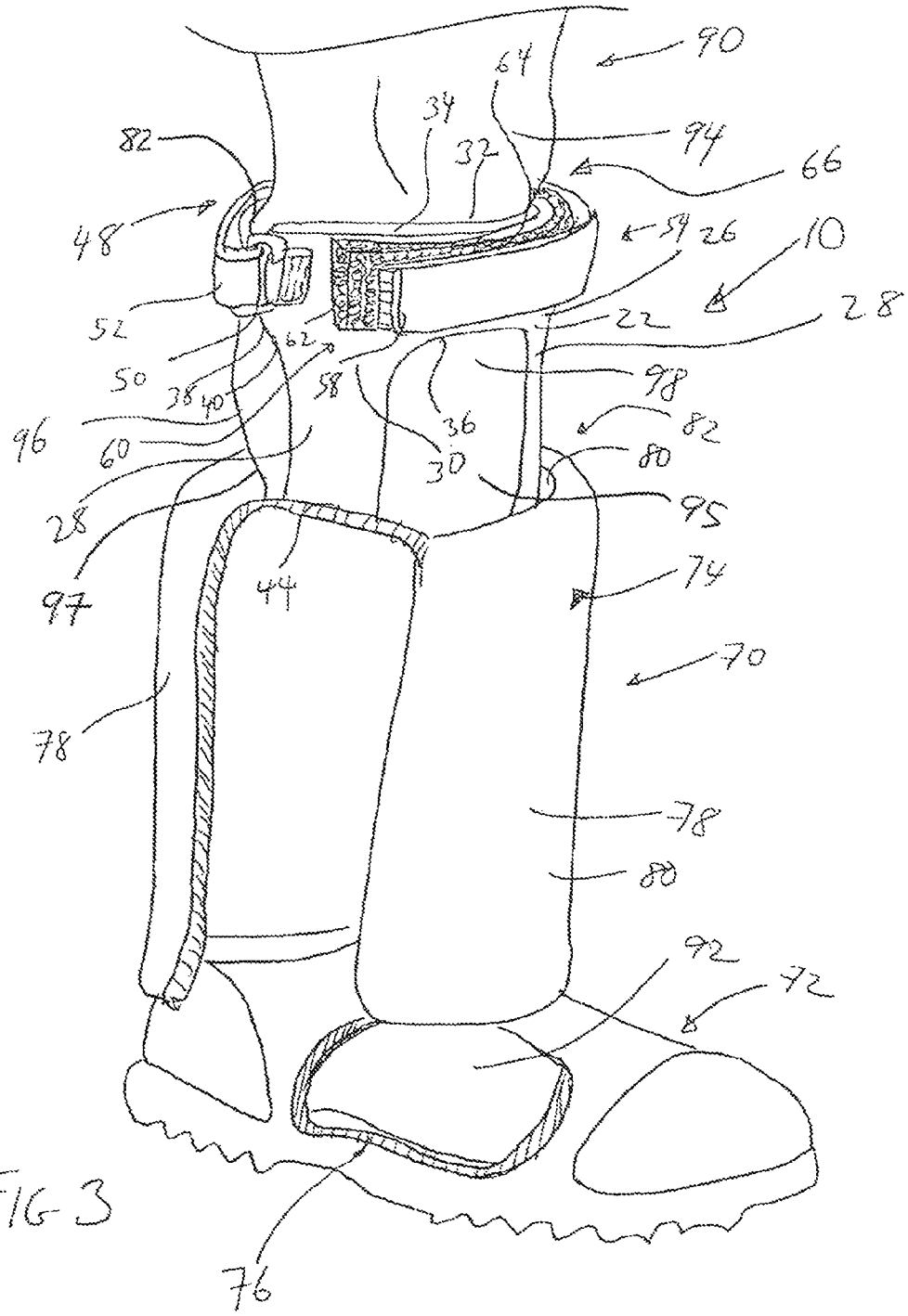
FIG. 3 is substantially a cutaway view of one embodiment of the present invention as attached to the operator.

As shown in FIGS. 1-3, the present invention 10 could comprise of wader retention system 20 and methodology of use 100 for same. A generally water-proof wader 70 (e.g., hip/boot wader or a leg covering section of chest wader—not shown) employing such a system 20 could have a unitary flexible laminate construction that could have a generally water-proof boot covering section 72 that is continuously connected with a generally water-proof leg covering section 74 having an a common wall 78 with an interior surface 80 and an exterior surface, the interior surface generally denoting a hollow interior 84 for generally receiving a respective a leg 90 and foot 92 of an operator. The leg covering section 74 could be open-ended with a leg aperture 82 continuously connected with the hollow interior 84 through which the operator's leg 90 and foot 92 passes into the wader 70 through when leg 90 and foot 92 is being located within the wader 70. The boot covering section 72 could further comprise of a foot portion 76 (generally denoted having a generally reinforced, exterior sole portion with treads for secure walking) into which the operator's foot 92 could be placed during the wearing of the wader 70.

The wader retention system 20 could comprise of a front leg securing portion 22 and a back leg securing portion 48. The front leg securing portion 22 could be made out of any suitable composition (e.g., flexible, sheet-like, water-proof, breathable material) as selected by those with ordinary skill in the art. The front leg securing portion 22 could further comprise of a rectangular body 26 with set of attachment straps 28. The body 26 could be defined in having a front side 30, a back side 32, top edge 34, bottom edge 36, and set of side edges 38 (e.g., a first side edge 40 and a second side edge 42.) Each attachment strap 28 could be located proximate to a respective side edge 38 with the attachment strap 28 extending outward from the bottom edge 36 and away from the body 26 so as to end in an attachment edge 44. Each attachment edge 44 being secured to an interior surface 80 of a wall 78 of the wader 70 (generally proximate to where the top of the boot covering section 72 connects to the bottom of the leg covering section 74.)

The back leg securing portion 48 could comprise of a loop 50, a belt 52, and a belt securing device 54. In one possible embodiment, the loop 50 could be made of suitable strong and generally rigid material (e.g., metal, plastic, and like) and be located proximate to the first side edge 40 of the body 26. As such, the loop 50 could be hingedly attached to the body 26 using neoprene or other attachment material suitable for such purposes. In other version, wherein the loop 50 is made of suitable flexible and strong material (e.g., leather), it could be directly attached to the body 26 proximate to the first side edge 40.

The belt 52 could be made of a suitably pliant material (e.g., leather) and could be attached by its first end 56 proximate to the second side edge 42 of the body 26. The second end 58 of the belt 52, during process of securing the operator's leg to the wader, could then be directed through the loop 50 (that is generally proximate to the first side edge 40) and then is doubled-over itself. In such placement, the second end 58 could be located proximate to the front side 30 of the body 26 to form a leg channel 66 with an adjustable circumference 68. When the belt 52, doubled over, is substantially at a proper length and position for operations, the second end 58 can be generally held against the front side 30 of the body 26 by the belt securing device 54.

The belt securing device 54 could be one or more various types of securing apparatuses known to those skilled in the art. One possible embodiment of the belt securing device 54 could a belt buckle type of securing device (not shown). Another possible embodiment of the belt securing device 54 could utilize a hook-and-loop attachment 60. This hook-and-loop attachment 60 could comprise of a hook pad 62 and loop pad 64 placed in proximity so they can mutually engage each other for securing purposes. The hook pad 62, a definite length of hook material substantially having the same or less width than the of the belt 52, is attached to a inner side of the belt 52 in such a manner so when the belt 52 is doubled-over itself after passing through the loop 50, the belt 52 could present the hook pad 62 against a loop pad 64 that is substantially located on the front side 30 of the body 26. In this manner, the hook pad 62/second end 58 could be movable placed against different portions of body 26/loop pad 64 to adjust the operational length of the doubled-over belt 52 to conform the wader retention system 20 to the particular shape and size of the operator's leg 90 proximate to the knee 94.

This adjustment action could constrict the circumference 68 of the leg channel 66 by bringing the front leg securing portion 22 and the back leg securing portion 48 closer together and constrict upon a portion of the leg 98 of an operator that has passed into the channel 66. In doing so, the back side 32 of the body 26 presses against the front of the leg 98 of the operator (e.g., generally below the knee 94, near the top portion of the shin 95) while a portion of the belt 52 presses against the back of the leg 96 (e.g., below the back of the knee 96 proximate to the top of the calf 97) to further secure the wader 20 to the operator's leg 90.

Process

Figure 4:
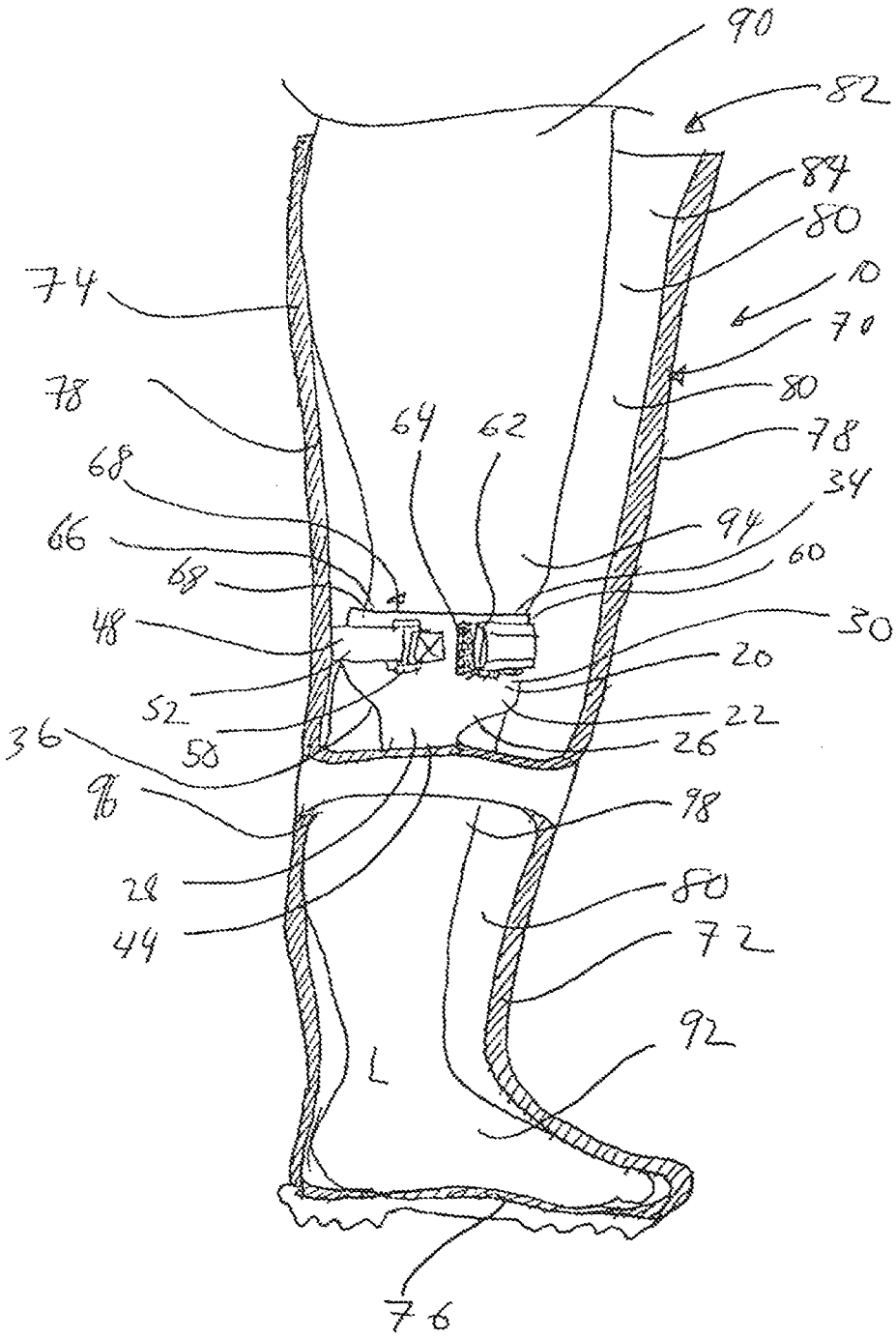
FIG. 4 is substantially another cutaway view of one embodiment of the present invention as attached to the operator.
Figure 5:
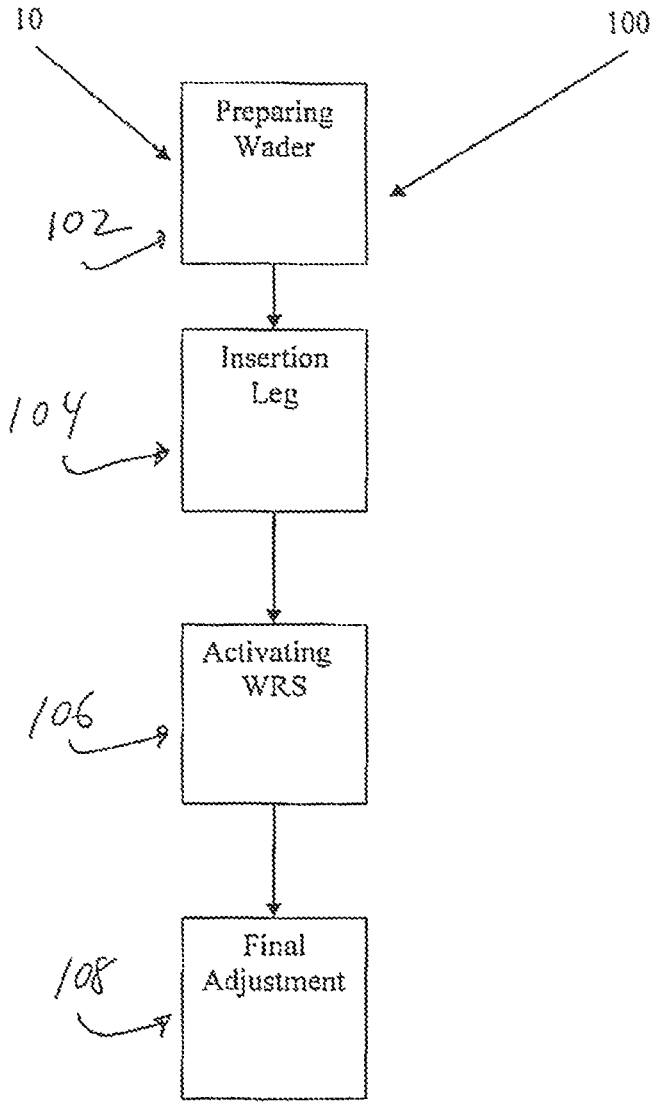
FIG. 5 is substantially a flow chart diagram showing the process for operating the invention.

As shown substantially in FIG. 4, the methodology or process 100 of operating the wader retention system 20 could start with step 102, preparing the wader. Here the operator for the boot/hip wader could pull a significant portion of the leg cover portion down over/proximate to the boot portion to expose the wader retention apparatus. The operator could then have access to and loosen (e.g., increasing the circumference of the leg channel) the wader retention apparatus by unlocking the belt securing device to generally release the second end of the doubled-over belt from the front side of the body to substantially increase the diameter/circumference of the leg channel to make it easier to slip the operator's foot/leg through the leg channel. In some instances of operation, the operator may need to remove the belt from the loop to open up the foot channel to a greater area for the greater ease of insertion of the foot/leg though the wader retention device. The operator can then grasp the sides of the wader to properly position the wader for the insertion of operator's leg and foot through the wader retention system 20. At the substantial completion of this step, the process 100 could generally proceed to step 104, insertion of leg.

In step 104, insertion of the leg, the operator can hold the wader to maneuver it into position to place the leg into the wader. The operator commences the placement of its leg into the wader by passing operator's foot though the leg aperture/wader retention device and pressing the foot down into the foot portion of the boot covering section. Once the operator's foot is properly located within the foot portion, the operator can move the wader/wader retention system so that it is located upon the leg just below the knee.

In step 106, activating the wader retention system, the operator could thread the second end of the belt through the loop and double it back against itself (if earlier needed to remove the belt from the loop to make it easier to pass the foot/leg through the leg channel) or otherwise pull on the belt (e.g., if already threaded though the loop) to decrease the circumference/diameter of the leg channel. This action could generally moving the back and front leg securing portions closer together to one another (as well as move the area/edge of attachment of the loop closer to the area/edge of attachment of the first end of the belt) to substantially bring the back side of the body snugly proximately against the front of the leg (e.g., top of the shim just below the knee) and the belt snugly proximately against the back of the leg (e.g., top of the calf just proximate to the back of the knee.) As the belt passes though the loop during this adjustment action, the loop may move relative to its attachment (rotate about the attachment) to allow the front and back leg securing portions to come closer together to reduce the diameter/circumference of the leg channel.

At the appropriate position of the second end of the belt upon the first leg securing portion, the belt securing device could be engaged to reversibly secure the second end of the belt to that point of front side of the body. This action belt securing device could include, in one possible embodiment, the relative positioning and engagement of the hook pad (e.g., second end) to the loop pad (e.g., front of the body.) After the substantial completion of this step, the process 100 could substantially proceed to step 108, final adjustment.

In step 108, final adjustment, the operator could pull up the leg portion so that the leg portion could appropriately cover the wader retention system, leg and other portions of the operator's body to place the wader in fully operational state. This action could be repeated for the other leg of the operator/wader, either sequentially ("one leg at a time" for hip/boot wader) or simultaneously (e.g., chest wader.)

When the waders are secured to the person of the operator in this manner, the adhesion/suction effect of the mud (and the like) on the boot portion when the operator steps into the mud with the waders, could be transmitted up the walls of the waders passing through the wader retention device and to the wearer's leg just below the knee. In this manner, as the operator's leg moves, it pulls the wader with it rather than stepping out of the wader due to suction/adhesion force.

To remove its leg from the wader, the operator could generally reverse the above steps, such as: pulling down the leg portion of the wader down over the boot portion to expose the wader retention system; generally deactivating the belt securing device; loosening the belt to increase the leg channel/moving the front and back leg securing portions away from one another, and removing the leg/foot from the wader retention device and the wader.

Conclusion

As described above, the invention provides for an easily adjustable device for reversibly securing a wader to an operator's leg that substantially resists the pulling-off effect provided by the suction/adhesion force of mud and like being traversed by the operator. Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

As generally disclosed in the application, the present invention provides a wader with a wader retention system at economic cost with little modification required of the wader; allows the wader to quickly grasp and reversibly lock onto a portion of operator's leg; and that easily adjusts for different sizes and shapes of the attachment area of the operator's leg.

What is claimed is:

1. A chest wader with a wader retention system, comprising:

(A) a chest wader having a unified pair of leg covering sections that are continuously connected in a manner that allows the chest wader to cover an operator's feet, legs and torso, the chest wader further comprising a front leg securing portion and a back leg securing portion;

(B) the front leg securing portion attaches to an interior wall of at least one respective leg covering section;

(C) the back leg securing portion comprises a belt, the belt having two ends, a first end that permanently connects to the front leg securing portion while a second end adjustably and reversibly connects to the front leg securing portion to allow the two portions to form a leg channel through which at least a portion of the operator's leg and foot may be reversibly passed through when inserted into the chest wader and through a respective leg covering section;

wherein the placement of the belt upon the front leg securing portion adjusts the circumference of the leg channel to allow the portions to reversibly and securely envelope the leg of the operator as located within the leg channel to retain the chest wader upon the operator.

2. The chest wader of claim 1 wherein the first end of the belt attaches to an edge of the front leg securing portion.

3. The chest wader of claim 2 wherein the back leg securing portion further comprises of a loop that attaches to another edge of the front leg securing portion that is different from the edge to which the first end of the belt is attached.

4. The chest wader of claim 3 wherein the loop is movably attached to the front leg securing portion.

5. The chest wader of claim 4 wherein the second end of the belt passes through the loop.

6. The chest wader of claim 5 wherein the belt folds back against itself after passing though the loop.

7. The chest wader of claim 6 wherein the belt moves through the loop to snugly locate the front leg securing portion and back leg securing portion upon a portion of the operator's leg passing through the leg channel.

8. The chest wader of claim 5 wherein the belt moves through the loop to move the edge of the front leg securing portion where the first end is attached closer to the edge of the front leg securing portion where the loop is attached.

9. The chest wader of claim 8 wherein the belt moving through the loop adjusts the size of a circumference of the leg channel.

10. The chest wader of claim 2 wherein the belt is adjustably secured in position against the front leg securing portion by a belt securing device.

11. A wader comprising of:

(A) at least one leg covering section that can at least partially encapsulate a leg of an operator;

(B) at least one boot covering section that can encapsulate a foot of the operator, the two sections being continuously connected and sharing a common interior wall further denoting a hollow interior which receives the operator's leg and foot as it passes through a leg aperture that is continuously connected to the hollow interior;

(C) a front leg securing portion that attaches to the interior wall;

(D) a back leg securing portion that comprises a belt, the belt having two ends, a first end permanently connected to the front leg securing portion while a second end adjustably and reversibly connects to the front leg securing portion to allow the two portions to form a leg channel through which the leg and foot may be reversibly passed through;

wherein the placement of the belt upon the front leg securing portion adjusts a circumference of the leg channel to allow the front leg securing portion and a back leg securing portion to reversibly and securely envelope a portion of the leg as placed within the leg channel so as to retain the wader upon the operator.

12. The wader of claim 11 wherein the back leg securing portion further comprises a belt securing device and a loop, the loop further attaches to the front leg securing portion at an area that is different from the area where the first end of the belt is permanently attached.

13. The wader of claim 12 wherein the second end of the belt passes through the loop.

14. The wader of claim 13 wherein the belt further doubles back over itself to allow the second end to be adjustably and reversibly secured to the front leg securing portion by the belt securing device.

15. The wader of claim 14 wherein the position of the second end upon the front leg securing portion and the movement of the belt through the loop adjusts the circumference of the leg channel.

16. A method of retaining a leg within a wader comprising the following steps but not necessarily in the order shown:

(A) providing a wader with a wader retention system, the system comprising of at least one front leg securing portion and at least one back leg securing portion that together form a leg channel with an adjustable circumference, the front leg securing portion attaches to an interior wall of the wader, the back leg securing portion comprises a loop, a belt, and a belt securing device, the loop attaches to an edge of the front leg portion, the belt has two ends, a first end permanently attached to another edge of the front leg securing portion that is different from the edge to which the loop is attached, and a second end passes through the loop;

(B) inserting a foot and leg of an operator into the wader to pass through the leg channel; and (C) positioning the second end relative to the front leg securing portion causing the front and back leg securing portions to snugly contact the leg to hold it within the wader.

17. The method of claim 16 further comprises a step of doubling the belt over itself.

18. The method of claim 16 wherein positioning the second end upon the front leg securing portion further comprises a step of reversibly securing the second end to the front leg securing portion with the belt securing device.

19. The method of claim 16 further comprises a step of moving the another edge of the front leg securing portion where the first end is attached closer to the edge of the front leg securing portion where the loop is attached.

20. The method of claim 19 further comprises a step of moving of the belt though the loop to adjust the circumference of the leg channel.

* * * * *